US006341585B1

(12) United States Patent
Warren

(10) Patent No.: US 6,341,585 B1
(45) Date of Patent: Jan. 29, 2002

(54) VARIABLE INLET VALVE DAMPER FOR AN INTERNAL COMBUSTION ENGINE

(76) Inventor: Edward Lawrence Warren, 3912 Snowy Egret Dr., West Melbourne, FL (US) 32904

( * ) Notice: Subject to any disclaimer, the term of this patent is extended or adjusted under 35 U.S.C. 154(b) by 0 days.

(21) Appl. No.: 09/657,242

(22) Filed: Sep. 7, 2000

(51) Int. Cl.[7] ..... F01L 1/34

(52) U.S. Cl. ..... 123/90.15; 123/90.12; 123/90.16

(58) Field of Search ..... 123/90.15, 90.16, 123/90.12, 198 F, 90.39, 90.46, 543, 48 R

(56) References Cited

U.S. PATENT DOCUMENTS

| | | | | | |
|---|---|---|---|---|---|
| 4,442,806 | A | * | 4/1984 | Matsuura et al. | 123/198 F |
| 4,515,121 | A | * | 5/1985 | Matsuura et al. | 123/198 F |
| 4,708,101 | A | * | 11/1987 | Hara et al. | 123/90.16 |
| 4,862,844 | A | * | 9/1989 | Wakeman et al. | 123/90.12 |
| 4,873,949 | A | * | 10/1989 | Fujiyoshi et al. | 123/90.12 |
| 4,919,089 | A | * | 4/1990 | Fujiyoshi et al. | 123/90.16 |
| 5,193,496 | A | * | 3/1993 | Kruger | 123/90.16 |
| 5,255,641 | A | | 10/1993 | Schechter | 122/90.11 |
| 5,287,829 | A | | 2/1994 | Rose | 123/90.12 |
| 5,515,818 | A | | 5/1996 | Born | 123/90.11 |
| 6,058,895 | A | * | 5/2000 | Hermsen | 123/90.16 |
| 6,116,222 | A | * | 9/2000 | Warren | 123/543 |
| 6,199,520 | B1 | * | 3/2001 | Warren | 123/48 R |
| 6,253,746 | B1 | * | 7/2001 | Warren | 123/543 |

* cited by examiner

*Primary Examiner*—Teresa Walberg
*Assistant Examiner*—Fadi H. Dahbour

(57) ABSTRACT

This invention is the addition of a variable inlet valve damper to an internal combustion engine so that it can reduce the amount of fluid sucked into the engine by allowing some of the fluid to be pushed back out during the compression cycle. This is accomplished by delaying inlet valve 14 closing. The variable inlet valve damper is made up of damper cylinder 2, damper piston 4, check valve 6 which allows fluid into damper cylinder 2 but not out of damper cylinder 2, and control valve 8 which varies the flow out of damper cylinder 2, fluid storage tank 9, bracket 10, and attachment 11. Without the addition of the variable inlet valve damper, inlet valve 14 would open immediately when cam 18 urged it to open and would close immediately when cam 18 allowed it to from the urging of valve spring 16. With the addition of the variable inlet valve damper, the timing of when inlet valve 14 closes can be varied to optimize engine operation. With control valve 8 open all the way, the engine operates at full power because all of the working fluid stays in the engine. As control valve 8 closes the engine keeps less fluid, the power of the engine is reduced, and the efficiency of the engine is increased.

3 Claims, 3 Drawing Sheets

VARIABLE INLET VALVE DAMPER FOR AN INTERNAL COMBUSTION ENGINE

BACKGROUND—FIELD OF INVENTION

The present invention relates to a variable valve damper for the inlet valves of reciprocating, internal combustion engines so that they will be able to change the amount of fluid compressed while operating; thereby effectively changing the size and power output of the engine.

BACKGROUND—DESCRIPTION OF PRIOR ART

At the present time most two stroke and four stroke internal combustion engines compress the same ammount of fluid at all operating conditions. They do not change the amount of fluid compressed to vary the power of the engine. To vary the power of the engine, they vary the fuel to fluid ratio and this varies the temperature. As the temperature varies from the design temperature, the efficiency of the engine decreases. In addition, present engines compress and expand their charge in the same volume. This results in under expansion of the charge when the power piston reaches the end of its power stroke, and the release of pressurized fluid that still has the ability to do work. If the engine expanded the charge more, it would be more efficient.

Previous inventions that delayed the closing of the engines inlet valve by using a damper had the valve stem as part of the damper, and the cylinder as part of the cylinder head. Engines of this type are the subject of patent application: Warren, Aug. 16, 2000, application Ser. No. 09/638, 950. The present invention is a modification of an internal combustion, reciprocating, engine by attaching a variable damper to the engine. The cylinder of the variable damper is attached to the cylinder head and the piston is attached to the valve. The engine requires minimum modification.

SUMMARY

This invention is: the addition of: "An inlet valve damper" to the inlet valve of an internal combustion engine so that it can reduce the amount of fluid sucked into the engine by allowing some of the fluid to be pushed back out before the compression cycle. This is accomplished by delaying the inlet valve's closing.

When the variable inlet valve damper causes the inlet valve to remain open so that some fluid is pushed back out, the amount of fluid to be compressed is reduced and the engine operates in a reduced power mode with the possibility of almost complete expansion of the fluid-fuel charge. When the variable inlet valve damper does not damp, and allows the inlet valve to close as soon as fluid starts to leave the engine, the engine operates in a greater power output mode.

OBJECTS AND ADVANTAGES

The advantage of the variable inlet valve damper is: The engine can be operated at full power where it has the same efficiency as an engine without a variable inlet valve damper, or it can be operated at reduced power where, because of increased expansion, it has more efficiency than at full power. Transferring this, for example, to an airplane for take off, the engine with a variable inlet valve damper has about the same power and efficiency an engine without a variable inlet valve damper. For cruise conditions, the engine without a variable inlet valve damper loses efficiency because it operates at lower temperature. An engine with a variable inlet valve damper increases in efficiency because it operates near the same temperature and has greater expansion. Therefore, this engine will get more miles per gallon. In addition, since this is an improvement to an existing engine it will not require massive expense and development.

DRAWING FIGURES

REFERENCE NUMERALS IN DRAWINGS

Figure 1:
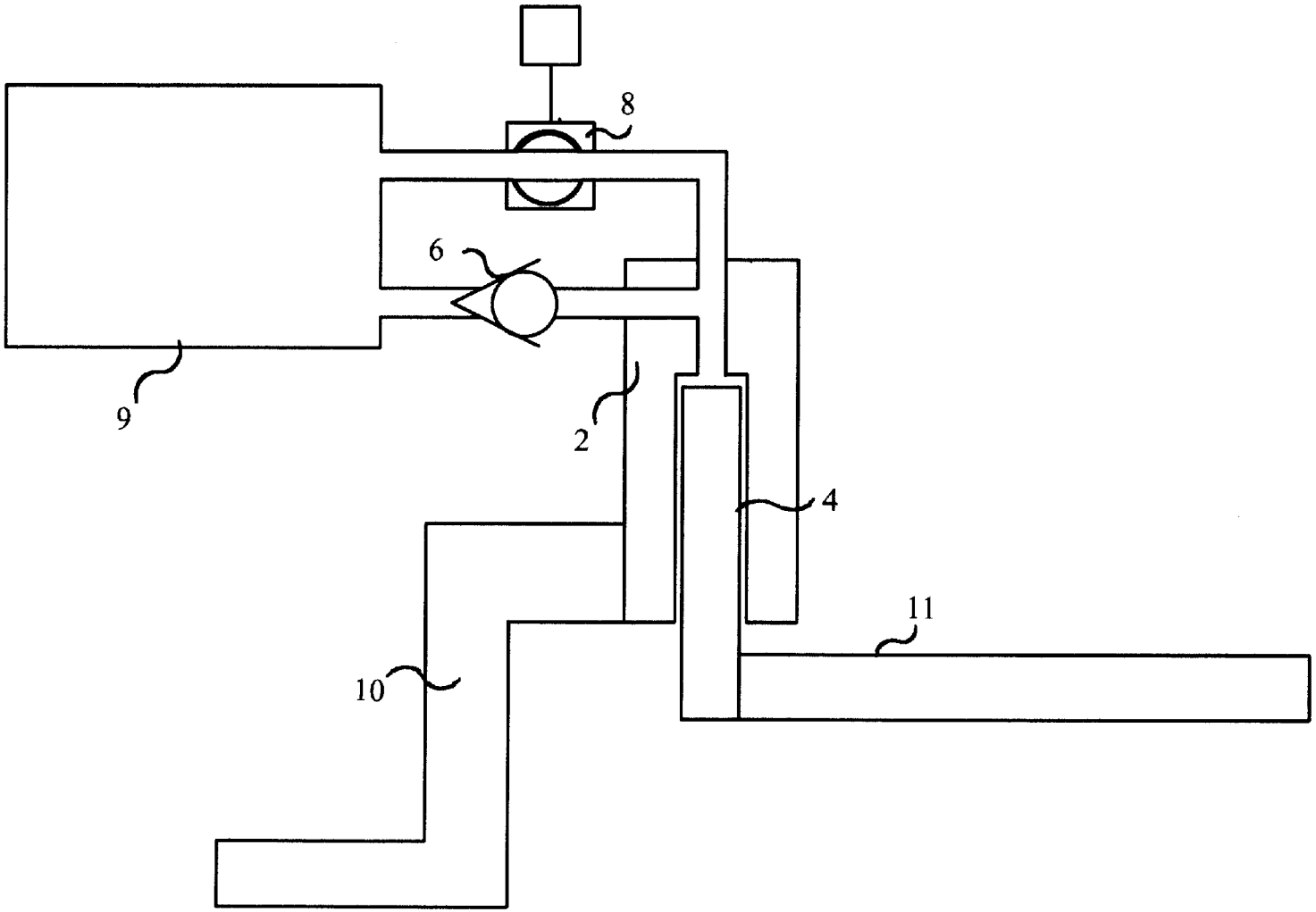
FIG. 1 Depicts a variable inlet valve damper.
Figure 2:
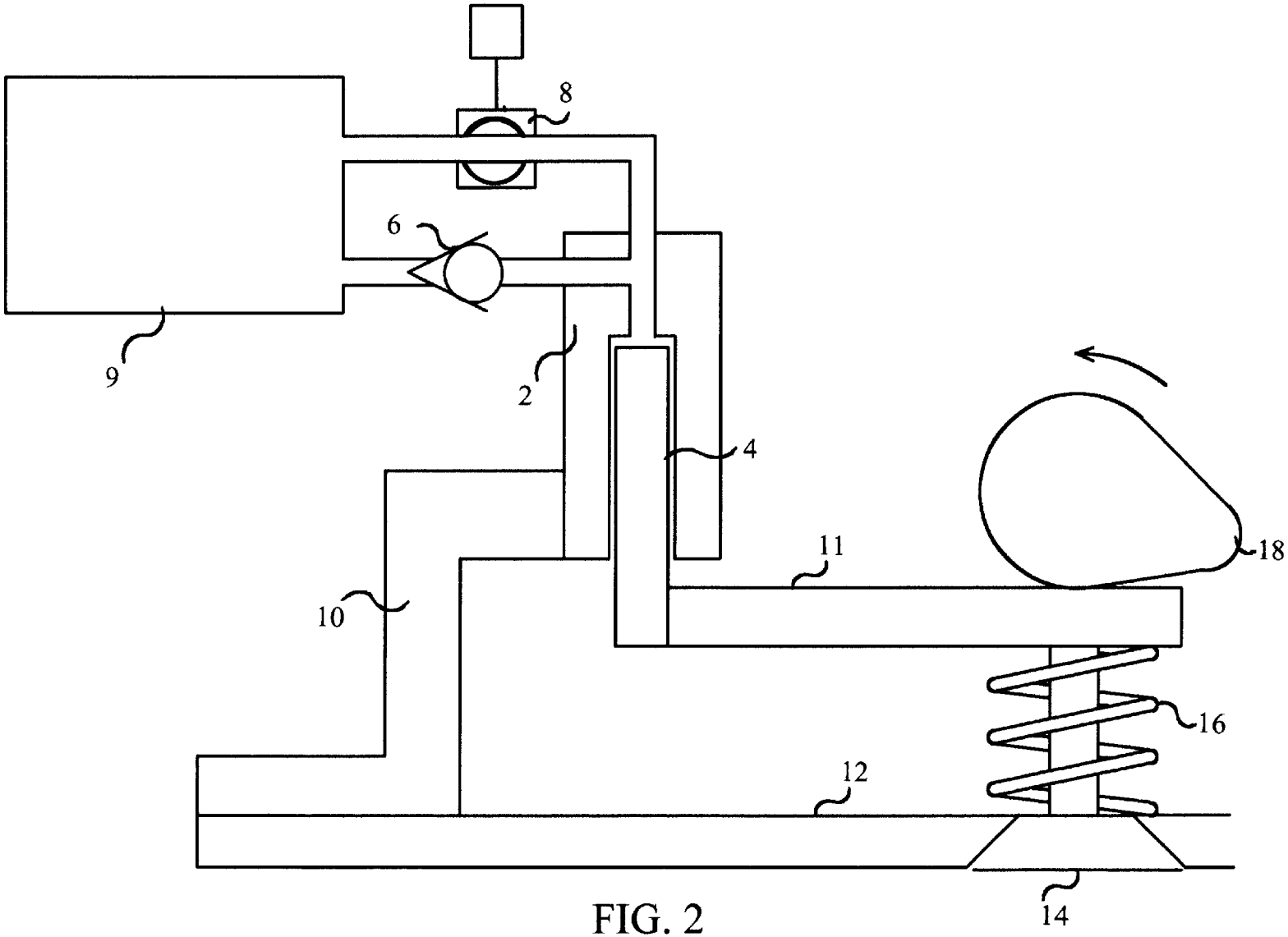
FIG. 2 Depicts a variable inlet valve damper as the inlet valve closes. The control valve is open.
Figure 3:
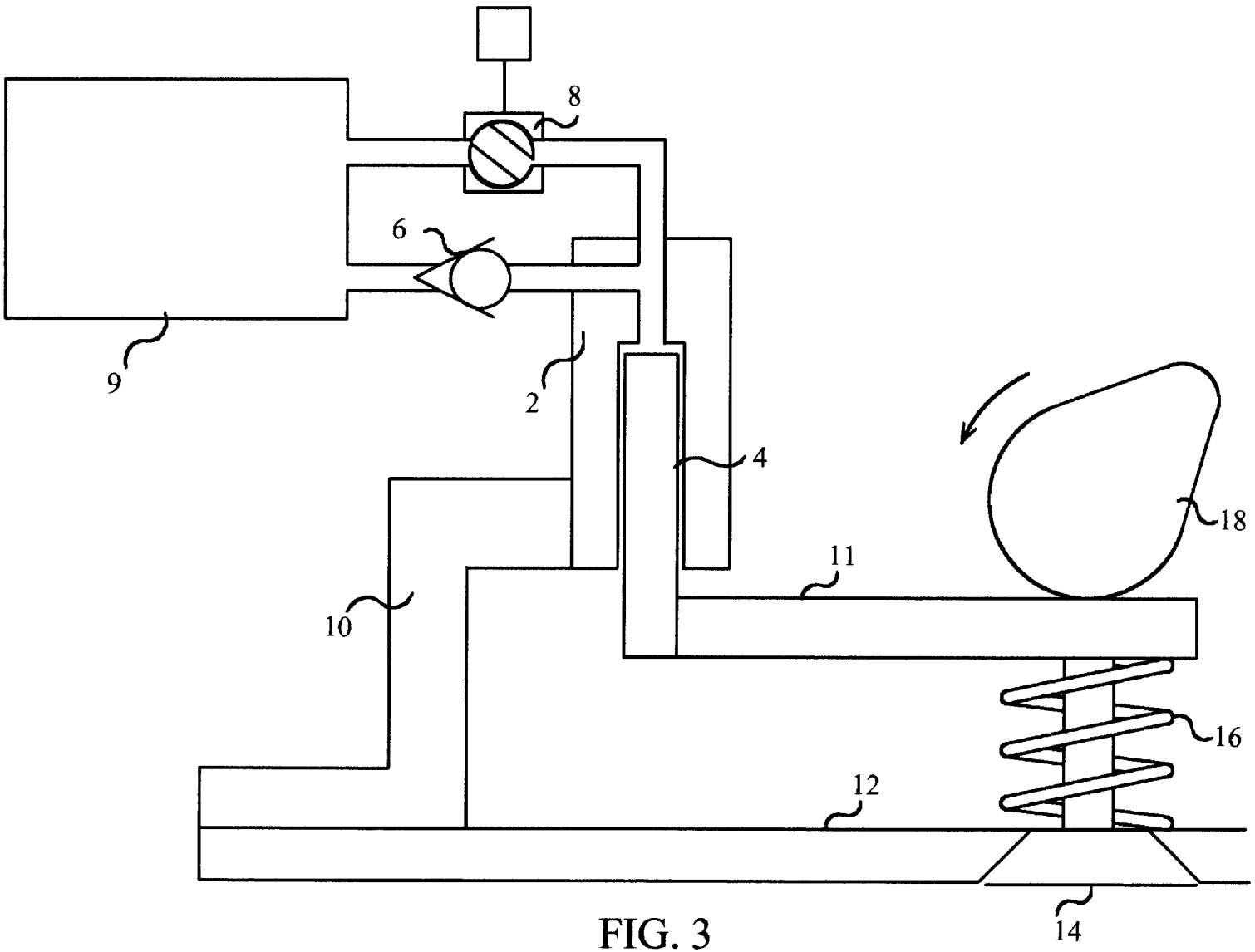
FIG. 3 Depicts a variable inlet valve damper as the inlet valve closes. The control valve is partially closed.

2 damper cylinder
4 damper piston
6 check valve
8 control valve
9 fluid storage tank
10 bracket
11 attachment
12 cylinder head
14 inlet valve
16 inlet valve spring
18 cam Description—FIGS. 1 to 3—Preferred Embodiment This invention is: the addition of a variable inlet valve damper to an internal combustion engine so that it can reduce the amount of fluid sucked into the engine by allowing some of the fluid to be pushed back out during the compression cycle. This is accomplished by delaying inlet valve 14 closing. Without the addition of the variable inlet valve damper, inlet valve 14 would open immediately when cam 18 urged it to open and would close immediately when cam 18 allowed it to from the urging of inlet valve spring 16. With the addition of the variable inlet valve damper, the timing of when inlet valve 14 closes can be varied to optimize engine operation.

FIG. 1 illustrates schematically the variable inlet valve damper. The variable inlet valve damper is made up of damper cylinder 2, damper piston 4, check valve 6 (which allows fluid into damper cylinder 2 but not out of damper cylinder 2 through check valve 6), and control valve 8 (which varies the flow out of damper cylinder 2), fluid storage tank 9, bracket 10, and attachment 11.

FIGS. 2 and 3 illustrate schematically the variable inlet valve damper attached to cylinder head 12 and to the inlet valve 14. Also shown are inlet valve spring 16, and cam 18.

FIGS. 2 and 3—Operation Variable Inlet Valve Damper

FIG. 2 depicts the engine during greater power operation, control valve 8 is all the way open. When cam 18 urged inlet valve 14 open, it opened immediately because check valve 6 allowed fluid to flow freely into damper cylinder 2. When cam 18 allows it to, (as shown in FIG. 2) inlet valve 14 closes immediately because control valve 8 is all the way open and no pressure builds up in damper cylinder 2.

FIG. 3 depicts the engine during the less power and greater efficiency compression cycle as the inlet valve closes. Control valve 8 is partially closed. When cam 18 urged inlet valve 14 open, it opened immediately because check valve 6 allowed fluid to flow freely into damper cylinder 2. When cam 18 allows it to, inlet valve 14 does not closes immediately because control valve 8 is partially closed and pressure built up in damper cylinder 2 is momentarily delaying the closing of inlet valve 14 (as shown in FIG. 3). This results in less power but greater efficiency operation of the engine.

Conclusion

Accordingly, the reader will see that a "Variable Inlet Valve Damper For an Internal Combustion Engine" meets the following objectives: The engine can be operated at full power where it has the same efficiency as an engine with out "Variable Inlet Valve Damper For an Internal Combustion Engine", or it can be operated at reduced power where, because of increased expansion, it has more efficiency than at full power. For cruise conditions, the engine without a "Variable Inlet Valve Damper For an Internal Combustion Engine" loses efficiency because it operates at lower temperature. An engine with a "Variable Inlet Valve Damper For an Internal Combustion Engine" increases in efficiency because it operates near the same temperature and has greater expansion. Therefore, this will get more miles per gallon. In addition, since this is an improvement to an existing engine it will not require massive expense and development.

I claim:

1. An apparatus for delaying the closing of an inlet valve of an internal combustion engine, comprising;

a fluid cylinder with a piston inside; said combination is connected between the engine cylinder head and said inlet valve, wherein, one end is connected to the engine cylinder head and the other end is connected to the inlet valve mechanism;

a fluid storage means;

a fluid control valve, that controls the rate of fluid flow, that is connected between said fluid cylinder outlet connection and said fluid storage means;

a fluid check valve arranged so that fluid flows one way, but no fluid flows the opposite direction, connected between said fluid cylinder outlet connection and said fluid storage means, said fluid check valve is plumbed parallel to said fluid control valve;

fluid inside said fluid cylinder between said piston and said fluid cylinder outlet, said control valve, said check valve, said control valve, and connecting piping;

a means of controlling said control valve.

2. A process for operating an engine equipped with the apparatus as recited in claim 4 that has the following steps:

a. when forces acting on said inlet valve urge said inlet valve open said check valve opens and allows a high flow rate of fluid into said fluid cylinder allowing said inlet valve to open immediately;

b. when forces acting on said inlet valve urge said inlet valve closed, said check valve closes and the rate of fluid flow out of said fluid cylinder through said control valve determines the closing time of said inlet valve; when lower engine power operation is desired, said control valve decreases the rate of fluid flow out of said fluid cylinder; when higher engine power operation is desired, said control valve increases the rate of fluid flow out of said fluid cylinder.

3. A process for operating an engine equipped with the apparatus as recited in claim 4 that has the following steps:

a. when forces acting on said inlet valve urge said inlet valve open said check valve opens and allows a high flow rate of fluid out of said fluid cylinder allowing said inlet valve to open immediately;

b. when forces acting on said inlet valve urge said inlet valve closed, said check valve closes and the rate of fluid flow into said fluid cylinder through said control valve determines the closing time of said inlet valve; when lower engine power operation is desired, said control valve decreases the rate of fluid flow into said fluid cylinder; when higher engine power operation is desired, said control valve increases the rate of fluid flow into said fluid cylinder.

* * * * *